United States Patent [19]

Delyannis

[11] 4,087,234

[45] May 2, 1978

[54] METHOD AND APPARATUS FOR BURNING FUEL

[76] Inventor: David S. Delyannis, 307 27th St., Union City, N.J. 07087

[21] Appl. No.: 645,897

[22] Filed: Dec. 31, 1975

[51] Int. Cl.[2] ..... F23D 11/04

[52] U.S. Cl. ..... 431/168; 431/9; 431/90; 431/353

[58] Field of Search ..... 431/168, 8, 9, 12, 90, 431/353, 169, 114, 1, 173; 110/28 F

[56] References Cited

U.S. PATENT DOCUMENTS

| | | | |
|---|---|---|---|
| 3,255,804 | 6/1966 | Lang | 431/1 X |
| 3,267,986 | 8/1966 | Olsson | 431/1 |
| 3,327,762 | 6/1967 | Saha | 431/173 |
| 3,556,700 | 12/1968 | Jackson et al. | 431/12 |
| 3,660,006 | 5/1972 | Crusta | 431/168 |
| 3,883,290 | 5/1975 | Windelbandt | 431/168 |
| 3,933,133 | 1/1976 | Shekleton | 431/168 |
| 3,963,407 | 6/1976 | Kofink | 431/353 X |

*Primary Examiner*—Edward G. Favors

[57] ABSTRACT

An improved method and apparatus are described for burning gaseous or vaporizable fuels, such as kerosene or other light fuel oils or gases. The burner provides for an efficient and complete burning of the fuel in a small combustion space and at variable rates. The burner utilizes a rotating fan to form a spiral or helical air flow within the combustion chamber. An interconnected rotating fuel nozzle for spraying the fuel into the spiral air path may be used or a stationary nozzle directing the fuel toward the fan. This provides for a long residence time of the fuel and air mixture providing a complete combustion of the mixture within the relatively small volume of the combustion chamber.

9 Claims, 5 Drawing Figures

SPEED CONTROL
PULSER
PUMP

METHOD AND APPARATUS FOR BURNING FUEL

BACKGROUND OF THE INVENTION

The present invention relates to an improved method and means for burning vaporizable fuels, such as kerosene or light fuel oils or gases. More particularly it relates to a fuel burning method and to a fuel burning apparatus which provides for an efficient and complete burning of the fuel in a small size and low weight burner and adjustable rates.

There are a number of prior oil burner designs in which the fuel is fed into and is ignited in an air stream for providing relatively efficient combustion. These prior oil burners all include means for supplying a relatively high volume of air to supply the oxygen for the combustion and include nozzle or other spray means for atomizing the fuel to facilitate its vaporization and ignition with the air stream. Prior oil burners have been characterized by having their various air impelling means and the atomizing nozzles or sprays specially designed for operation at a particular level of combustion to provide a predetermined btu output. While certain changes were possible by making adjustments in these elements, any significant change in heat requirements required a replacement of an entire burner or at least of the important impeller nozzle and elements. Additionally, the known oil burners utilize relatively complex atomizing means with intricate passages and ports which are subject to clogging and those burners having a relatively high combustion rating or high btu output have required relatively large overall structures.

By way of contrast, the combustion apparatus and method of the present invention utilize a novel spiral or helical flow pattern of fuel and air formed by a relatively simple nozzle and air impeller combination mounted within a compact combustion chamber. A single configuration and size of the improved burner may have a variety of burning rates which are obtained by only minor adjustments of motor speed and in certain cases by a related adjustment of the fuel feed rate.

Accordingly, an object of the present invention is to provide an improved fuel burner for a variety of fuels.

Another object of the present invention is to provide an improved fuel burner capable of operation at differing combustion rates.

Another object of the present invention is to provide an improved burner providing efficient burning of fuel in a small combustion space.

Another object of the invention is to provide a high capacity burner having a low electrical energy requirement.

Other and further objects of the invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWING

A preferred embodiment of the invention has been chosen for purposes of illustration and description and is shown in the accompanying drawing, forming a part of the specification, wherein.

DESCRIPTION OF THE PREFERRED EMBODIMENT

Figures 1, 2, 3, 4, 5:
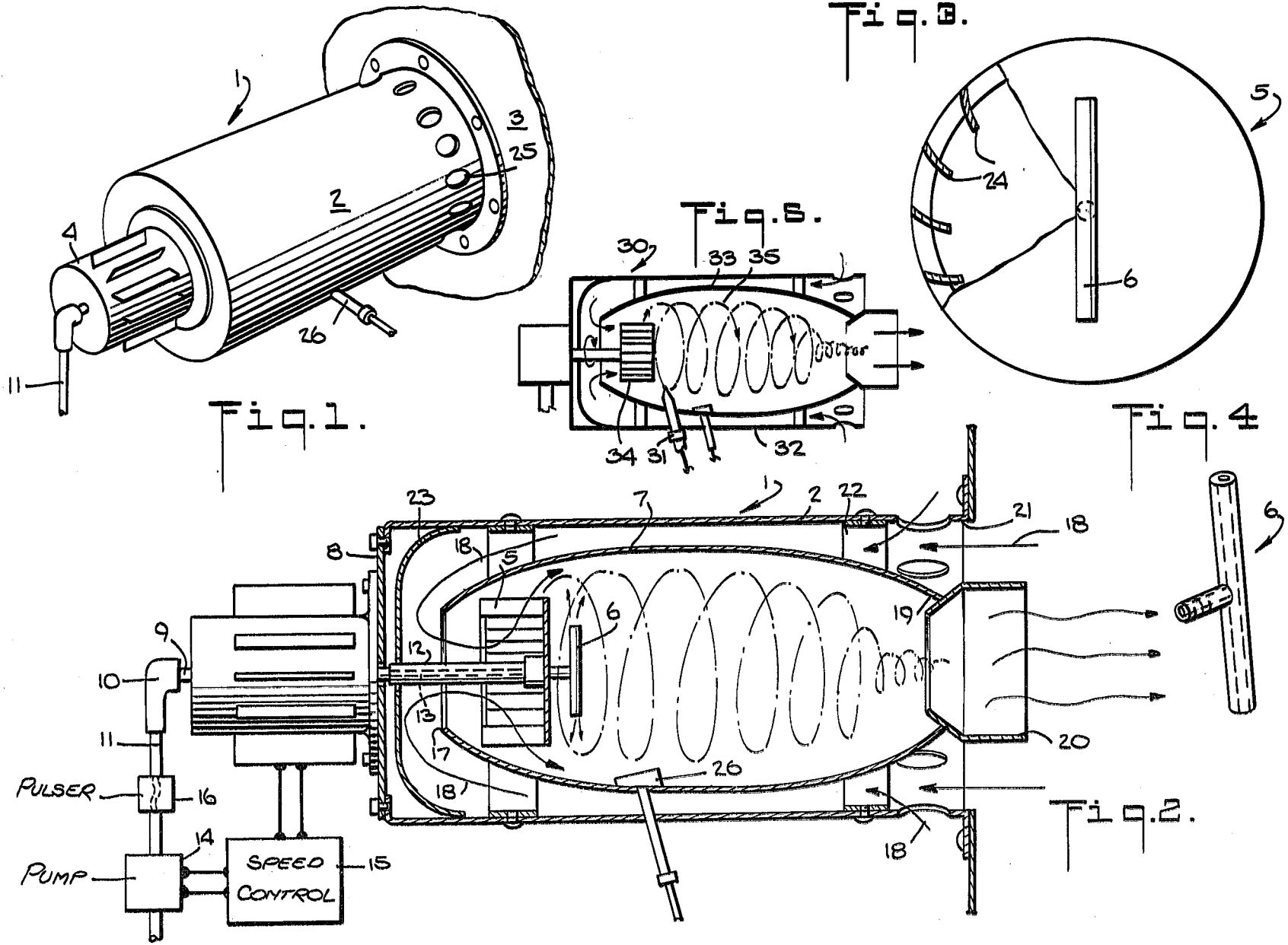
FIG. 1 is a perspective view of a preferred embodiment of the burner mounted on a boiler.
FIG. 2 is a vertical sectional view of the burner of FIG. 1 illustrating the preferred spiral or helical air flow pattern within the combustion chamber.
FIG. 3 is a front elevational view of the nozzle and the impeller unit.
FIG. 4 is a perspective view of a preferred form of the fuel nozzle.
FIG. 5 is a fragmentary vertical sectional view illustrating a differing fuel nozzle design.

The improved method and apparatus of this invention provide a burner for a variety of uses including use in oil heated houses or apartments or industrial heating or power boilers or for portable boilers. As will be seen from the following description, the method and apparatus are particularly useful in such installations as one size unit may be used for a variety of boiler sizes. Simple operating adjustments only need to be made for changing the burner heat output. In addition, the method and apparatus are advantageous in these uses and in a variety of other heater uses because of the relative simplicity and small overall size of the unit.

The drawing illustrates a preferred embodiment of an oil burner 1 in accordance with the invention. An outer shell 2 is provided which functions to provide a heat shield as well as a physical support for mounting the burner 1 on a boiler 3. It also mounts a drive motor 4 for an air impeller or fan 5 and a spray nozzle 6. The outer shell 2 surrounds an inner combustion chamber 7.

The drive motor 4 for the air impeller 5 and the fuel nozzle 6 is mounted on the end plate 8 of the outer shell 2. The electric drive motor 4 has a hollow shaft 9 whose outer end is coupled by a rotary coupling or gland 10 to a fuel supply line 11 and whose inner end supports a shaft extension 12 for mounting the impeller 5 and the fuel nozzle 6. The use of the hollow shaft 9 for supplying the fuel to the nozzle 6 provides for a convenient entrance of the fuel to the nozzle 6 and also permits the fuel to act as a coolant for the motor 4. The inner end of the shaft extension 12 is provided with threads or other means for coupling the fuel nozzle 6 to a fuel conduit 13 in the shaft extension 12. Fuel, fed under pressure, passes through the shaft 9 and the extension 12 to the nozzle 6 and thence into the combustion chamber in a manner more fully described below.

An auxiliary fuel pump 14 may be used on the fuel line 11 where a high burning rate may require a high rate of fuel feed. Where the fuel is supplied to the line 11 under pressure, this pressure plus some pumping action supplied by the rotating nozzle 6 makes the auxiliary fuel pump unnecessary. The fuel pump 14 may be electrically driven and connected to the same control 15 as the motor 4. When the burner rate is changed a common adjustment of the motor 4 speed and the pump 14 rate is all the adjustment required.

An optional fuel pulser 16 may be used for liquid fuels when noise is not annoying or is dampened by baffles. The pulser 16 is a mechanical device which restricts the flow of fuel in pulses. It is a short length of very soft synthetic rubber tube with a bend in it connected in the fuel supply line 11. Its pulse frequency and size is determined by the size and back pressure of the burner. Its function is to give a marked increase in heat transfer of the burned gases to the medium being heated. It is especially effective in the case of heating boiler tubes or metal.

The improved combustion chamber 7 and the air flow and fuel feed to and within the chamber during combustion will now be described. The burner 1 employs a relatively small combustion chamber 7 which in its preferred form has an ovoid shape. The chamber 7 is mounted on cooling and mounting fins 22 within the outer shell 2, as described above, with its inner end 17 open for the purpose of receiving the incoming air 18 and with its outer end 19 open and mounting a generally cylindrical outlet or baffle 20 for directing the flame into the particular boiler 3 or other device being heated. The impeller 5 is mounted on the motor shaft extension 12 and is positioned inwardly of the open inner chamber end 17. The air 18 is drawn inwardly through the open end 21 of the outer shell 2 including a number of air openings 25. The air 18 passes inwardly over the outer surface of the combustion chamber 7 and thence around a curved guide plate 23 into the open inner end 17 of the combustion chamber 7. The impeller 5 is chosen so that its air output flows with a high velocity outwardly to and generally along the inner surface of the combustion chamber 7 toward outlet end 19. A squirrel cage impeller 5 with generally radially mounted impeller blades 24 provides this air flow and forms a preferred flow pattern for the air and the products of the combustion. This flow, as illustrated in FIG. 2, is a generally helical or spiral flow wherein the mixed air and fuel and the combustion products or flame 25 circle the interior of the combustion chamber 7 many times as 100 or more turns at a rate just slightly less than the rotational rate of the impeller 5 and with a forward or axial component of motion which carries the hot combustion flame through the combustion chamber 7 and out of the baffle 20 for providing the boiler heating action. The spiral combustion path may be 100 feet or more in length in a chamber with a length of about 1 foot or less.

The inward flow of the air 18 between the outer shell 2 and the outer surface of the combustion chamber 7 provides a desired preheating of the combustion air 18 for facilitating the vaporizing and burning action within the combustion chamber 7.

The chamber 7 and the impeller 5 are made of metal which may be operated without damage at the high furnace temperatures. Inconel or high temperature stainless steel alloys may be used.

One preferred method and means for supplying the fuel will now be described which provides a long residence time of the fuel mixture within the combustion chamber and an intimate mixing of the fuel and the air for combustion. This result is obtained by feeding the fuel through the hollow center of the motor shaft extension 12 and into the rotating end mounted nozzle 6. The nozzle 6 may have one radially directed outlet but preferably has two outlets of the general form illustrated in FIG. 4. One satisfactory nozzle, for example, comprises a T-shaped tubular form having a relatively large free flowing fuel bore which may be about 0.187 inches in a 0.25 diameter tube. This nozzle 6 rotates at the fan speed with the result that liquid fuel being ejected by the nozzle is in the form of an atomized spray with the atomization occurring as fuel droplets are thrown radially outwardly toward the inner surface of the combustion chamber 7. The fuel droplets immediately begin to vaporize from the heat of combustion so that combustion occurs as the particles are carried along the spiral or generally helical path of the fuel air mixture and the products of combustion as already described above. Fuel particles which are not fully vaporized strike the combustion chamber 7 walls at which time they are further reduced in size and are immediately vaporized to burn as they are carried along in the turning fuel mixture and flame path. Within a very short time of ignition, the inner wall of the combustion chamber 7 becomes red hot to insure an efficient and continuing and uniform ignition and uniform flame density within the combustion chamber 7. An ignitor 26 is mounted on the wall of the combustion chamber 7 which may use an electrically heated nichrome wire or an ignition spark for initiating combustion. Other ignition means may be used for initiating and for insuring continuous combustion.

A gaseous fuel may be fed through the same rotating nozzle described above.

FIG. 5 illustrates an alternative embodiment with a stationary fuel feeding nozzle. This burner is similar to the above described burner 1 of FIGS. 1–4 except for the fuel feeding or nozzle structure.

In place of the rotating nozzle 6 the burner 30 of FIG. 5 has a fixed nozzle 31 mounted in suitable apertures in the outer shell 32 and the combustion chamber 33. The nozzle 31 is preferably positioned to direct the fuel towards the rotating fan or impeller 34 which may be similar to the impeller 5 to form the spiral pattern 35 for the burner flames.

Where the nozzle 31 is feeding liquid fuel, the direction of the nozzle spray towards the rotating impeller 34 provides for a secondary atomizing effect for any fuel particles which strike the impeller 34. Where a gaseous fuel is being used, the nozzle directs the gas towards the outer edge of the impeller 34 to feed the fuel into the spiral pattern.

A burner in accordance with the present invention may have a combustion chamber volume as small as one-seventh of a cubic foot or approximately 250 cubic inches. A burner of this volume has been tested and has shown a capability of operating efficiently for a wide range of heating output values. A burner of this size, for example, will efficiently burn fuel at the rate of from about 0.2 to 6 gallons per hour using kerosene or light fuel oils. Thus, a burner in accordance with the invention in a single size may be employed to provide a heating output of from about 28,000 to 840,000 btu per hour. The fuel feed rate and air flow are adjusted to provide this range without burner structural changes. Burners manufactured with the general shapes illustrated in the drawing may have combustion chambers with a length of about 3½ times the impeller diameter with the open ends of the combustion chambers being about one impeller diameter and with the central portions of the combustion chambers being about one and one-quarter blade diameters. Such burners require only the minimal electrical energy input for a motor of less than 100 watts.

OPERATION

As already indicated, an efficient combustion is obtained by directing the fuel into a stream of air which is given a spiral or generally helical motion. During the combustion, therefore, the fuel burns as the flame or hot gases of combustion move in a continuing curved path of great length. This path, for example, is relatively long compared with the dimensions of the chamber being many times longer than the maximum dimension of the combustion chamber. The combustion is initiated by energizing the igniter and by commencing the air and fuel input. The fuel or fuel vapor at the ignitor initiates the flame which rapidly results in full combustion in the above described manner. The initial fuel feed and air flow may be a reduced flow for an initial period of several seconds to provide for a smooth ignition operation.

It will be seen that an improved method and apparatus for the combustion has been disclosed. The improved method and apparatus provide for an efficient and complete burning of fuel in a relatively small combustion space. This permits the apparatus to be of small size and of low weight while providing relatively high heat output. In addition, the improved method and apparatus are particularly suited for meeting varying or variable heating requirements so that one burner size may be used with differing heating requirements or boiler sizes and so that the heating output of the apparatus may be adjusted during use in accordance with thermostatically controlled heat requirements.

The method and apparatus also require only a relatively low electrical power expenditure per gallon of kerosene or light fuel oil. These improved results are obtained by the above described general principal of long residence time and intimate mixing of fuel and air within the combustion chamber.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. An improved oil burner comprising the combination of:

a hollow combustion chamber having an inlet at one open end and an oulet at an opposite open end;

a squirrel cage impeller positioned within the chamber at the inlet for drawing air into one open end of said chamber and for causing the air to move through the chamber in a helical stream;

means for spraying the fuel oil into the stream of air adjacent to and inwardly of the impeller to form an air and fuel mixture including means for directing the fuel towards the interior walls of the chamber; and means for igniting the fuel oil and air mixture for producing a flame which passes through said chamber and out the opposite open end in a helical path.

2. The burner as claimed in claim 1 in which said means for spraying the fuel comprises a nozzle mounted for rotation with said impeller moving its oil outlet in a circular path.

3. The burner as claimed in claim 2 which further comprises an electric drive motor having its shaft coupled to said fan and wherein said drive shaft has a hollow center coupled at one end to the nozzle and at its opposite end to a source of fuel oil.

4. The burner as claimed in claim 1 in which said means for spraying comprises a nozzle fixedly mounted in said combustion chamber wall.

5. The burner as claimed in claim 1 in which said combustion chamber is generally ovoid in shaped.

6. The burner as claimed in claim 1 which further comprises a pulser in the fuel spraying means.

7. The burner as claimed in claim 3 which further comprises a fuel pump coupled in the fuel spraying means and means for simultaneously controlling the outputs of said motor and said pump.

8. An improved burner for liquid fuel comprising the combination of:

a hollow combustion chamber having an inlet at one open end and an outlet at an opposite open end and being of generally ovoid shape;

a squirrel cage impeller positioned within the chamber at the inlet for feeding air into one open end of said chamber with a generally helical path of motion;

a nozzle mounted for rotation with said fan adjacent to and inwardly of the impeller for spraying the liquid fuel into the stream of air for directing the fuel towards the inner side walls of the chamber to form an air and fuel mixture;

means for igniting the fuel and air mixture for producing a flame which passes through said chamber and out the opposite open end in a helical path;

an electric drive motor including a mounting shaft for said fan and said nozzle; and a fuel conduit in said shaft communicating with said nozzle and coupled to a fuel inlet.

9. The burner as claimed in claim 8 which further comprises a fuel pump in said fuel inlet and means for simultaneously controlling the output of said motor and said pump.

* * * * *